United States Patent [19]

Sturdevan et al.

[11] Patent Number: 4,790,767

[45] Date of Patent: Dec. 13, 1988

[54] ELECTRICAL CONNECTOR FOR A DISTRIBUTORLESS IGNITION SYSTEM

[75] Inventors: Ronald P. Sturdevan, Tifton, Ga.; Michael E. LaCanne, Marysville, Mich.

[73] Assignee: Prestolite Wire Corporation, Farmington Hills, Mich.

[21] Appl. No.: 121,077

[22] Filed: Nov. 16, 1987

[51] Int. Cl.[4] ..... H01J 13/44

[52] U.S. Cl. ..... 439/125; 439/127

[58] Field of Search ..... 439/125–130, 439/750; 123/169 PA; 313/135; 315/56, 57, 58

[56] References Cited

U.S. PATENT DOCUMENTS

| | | | |
|---|---|---|---|
| 2,296,054 | 9/1942 | Rabezzana | 439/126 |
| 2,943,139 | 6/1960 | Skunda | 439/125 |
| 2,965,871 | 12/1960 | Seyfarth | 439/125 |
| 3,002,126 | 9/1961 | Noir | 439/125 |
| 3,076,113 | 1/1963 | Candelise | 439/125 |

*Primary Examiner*—Gil Weidenfeld
*Assistant Examiner*—Gary F. Paumen
*Attorney, Agent, or Firm*—Remy J. VanOphem

[57] ABSTRACT

An electrical connector for connecting a spark plug cable to the high voltage output terminal of a distributorless ignition system. The connector has a tower member having a cup-shaped electrode which electrically connects the spark plug cable's electrical terminal with the high voltage output terminal of the distributorless ignition system. An insulator boot encloses the end of the spark plug cable and engages the tower member to form a watertight seal. A retainer, circumscribing a portion of the insulator boot, has a pair of latches which engage a radial flange provided on the tower member to lock the insulator boot to the tower member to maintain the watertight seal and hold the spark plug's electrical terminal securely in the tower member's cup-shaped electrode. A lock tab provided on the retainer engages a notch provided in the insulator boot to lock these two components together.

27 Claims, 1 Drawing Sheet

ELECTRICAL CONNECTOR FOR A DISTRIBUTORLESS IGNITION SYSTEM

BACKGROUND OF THE INVENTION

1. Field of the Invention

The invention is related to electrical connectors and, in particular, to an electrical connector for a distributorless ignition system.

2. Description of the Prior Art

Electrical connectors for the ignition systems of internal combustion engines are designed with two objectives in mind. The first is to make good reliable electrical connections at both the spark plug and at the source of the high voltage ignition signal, and the second is to isolate these electrical connections from the dirt and hostile environment encountered under the hood of an automotive vehicle. To protect the electrical connection, the prior art teaches the use of rubber or rubber-like boots as taught by Candelise in U.S. Pat. Nos. 3,076,113; Goldowsky in 3,911,203; and Fitzner in 3,965,879. Fitzner also teaches a metal electrostatic shield which completely encloses the insulator boot. This metal electrostatic shield is electrically and mechanically attached to the spark plug by a lip which engages the underside of the spark plug's hex nut and which is held in place by a coil spring. Rabezzana in U.S. Pat. No. 2,296,054 teaches a Bakelite cover for the electrical connection between the spark plug wire and the spark plug which has a pair of spring loaded latches which engage the underside of the spark plug's hex nut to hold the Bakelite cover over the end of the spark plug.

Jones et al in U.S. Pat. No. 3,876,280 teaches a bimetal connector for underground electrical distribution systems which has a neoprene boot molded or bonded inside a rigid plastic housing. The neoprene boot covers the electrical connection between the cable and the terminal and makes a watertight seal with the external surface of a conical receptacle of a transformer or other high voltage device. Roman, Jr. in U.S. Pat. No. 4,225,206 teaches a multiple lead connector for a fuel injector or similar type device having a central boss flanked by a pair of pin terminals. The connector has a structural plastic housing from which pivotably depends a pair of diametrically disposed latch members. The latch members engage the underside of an enlarged head of the fuel injector's central boss to lock the connector to the fuel injector housing. An elastomeric boot or seal member is compressed between the fuel injector housing and the connector housing to form a watertight seal. In a somewhat similar manner, Margrave et al in U.S. Pat. No. 4,376,563 teach a multiple lead connector having a latch member securing the male and female halves of the connector. A peripheral elastomeric seal is compressed in an annular slot formed between the male and female portions of the connector to form a watertight seal. Finally, Stone in U.S. Pat. No. 4,268,101 teaches an electrical connector having a pair of integrally formed contact members which are biased towards each other so as to reliably contact a projecting male electrode. The contact members have arms extending external to the connector which when compressed towards each other release the integrally formed contact members from the male electrode.

The invention is an electrical connector for a distributorless ignition system which is addressed to the same problems encountered under the hood of an automotive vehicle as the electrical connectors for connecting the spark plug cable to the spark plugs.

SUMMARY OF THE INVENTION

The invention is an electrical connector for connecting the electrical terminal of a spark plug cable to a high voltage output terminal of a distributorless ignition system. The connector includes a tower member having an electrode for making an electrical connection between the electrical terminal of the spark plug cable and the high voltage output terminal of the distributorless ignition system and an insulator boot having a central bore for receiving a portion of the spark plug cable and a portion of the electrical terminal. The forward end of the insulator boot engages the tower member to make a watertight seal. The connector also has a retainer for locking the insulator boot to the tower member to maintain the watertight seal and to secure the electrical connection between the spark plug cable's electrical terminals and the tower member's electrode.

One object of the invention is to provide an electrical connector for securely connecting the electrical terminal of a spark plug cable to the high voltage output of a distributorless ignition system.

Another object of the invention is to provide a connector having means for releasibly locking the retainer to the tower member.

Another object of the invention is to accomplish locking of the insulator boot to the retainer to assure they will be withdrawn from the tower member as a unit.

A final object of the invention is to provide an electrical connector which provides a watertight seal about the connection between the electrical terminal and spark plug and the connection between the electrical terminal and the electrode of the tower member.

These and other objects of the invention will become more apparent from a reading of the detailed description of the invention in connection with the appended drawings.

DETAILED DESCRIPTION OF THE PREFERRED EMBODIMENT

Figure 3:
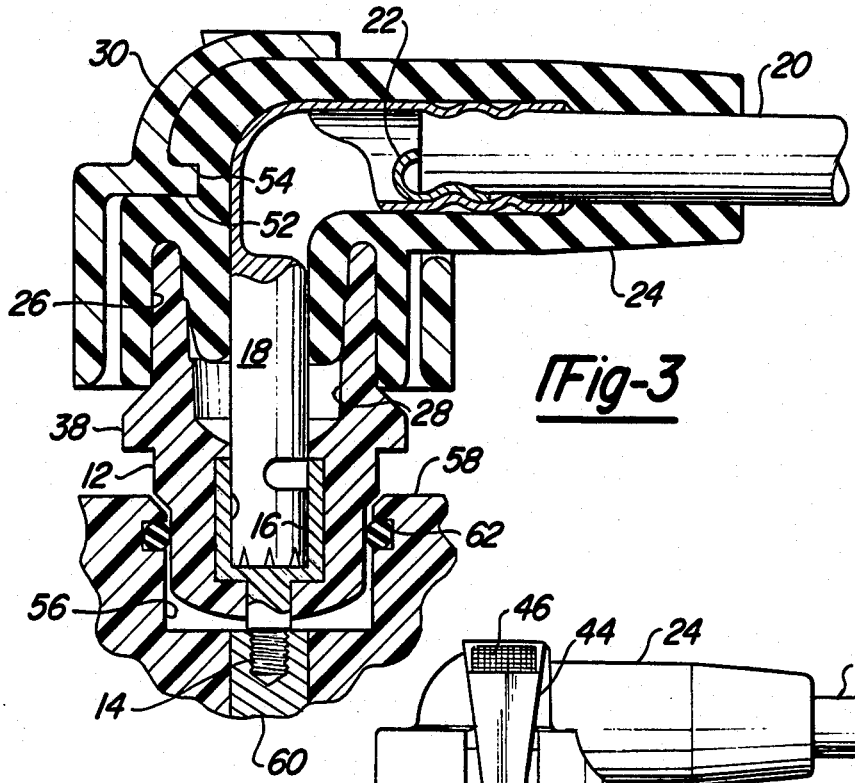
FIG. 3 is a cross-sectional side view of the connector showing the internal details thereof.
Figure 1:
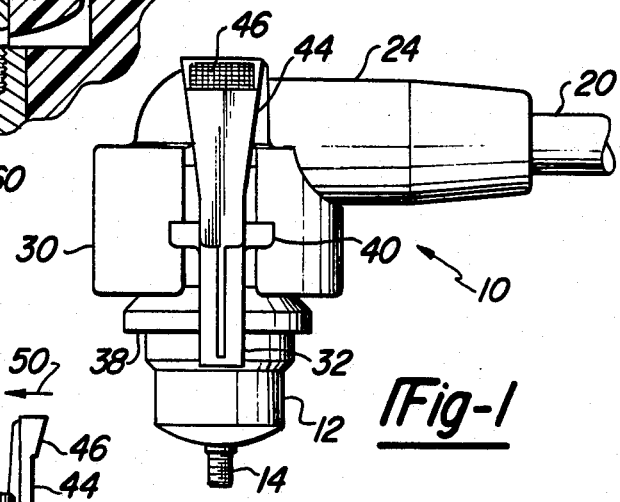
FIG. 1 is a side view of the connector.
Figure 2:
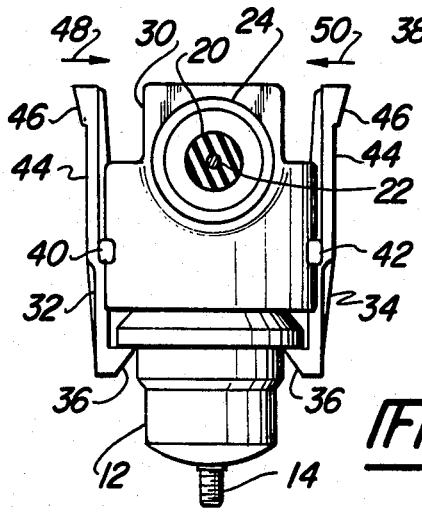
FIG. 2 is an end view of the connector.

An electrical connector 10 for a distributorless ignition system is shown in FIGS. 1 through 3. The electrical connector 10 is used to secure the connection of an ignition cable to the individual coils of a distributorless ignition system, such as disclosed by Asik in U.S. Pat. Nos. 4,478,201 or Iwasaki in 4,382,430. In these distributorless ignition systems, each spark plug has its own (separate) capacitor or ignition coil for producing a high voltage ignition signal which is transmitted to the associated spark plug.

Referring to FIGS. 1 through 3, the electrical connector 10 has a dielectric tower member 12 which mounts directly in a well 56 of a housing 58 which encloses the distributorless ignition system. The tower member 12 is made from Bakelite or a structural plastic material having excellent dielectric characteristics which is highly resistant to electrical breakdown under high voltage conductions. The distributorless ignition system may embody one or more high voltage generators (ignition coils) as is known in the art. A threaded shaft 14 protruding from the base of the tower member 12 is threaded into a threaded bore on a high voltage terminal 60 fixedly attached to the housing 58. The threaded shaft 14 is an integral extension of a cup-shaped electrode 16, as shown in FIG. 3. An "O" ring 62 forms a watertight seal between the side walls of the well 56 and the tower member 12. Alternatively, the space between the tower member 12 and the walls of the well 56 may be filled with a potting material to form the watertight seal.

The cup-shaped electrode 16 i adapted to receive the free end of an L-shaped electrical terminal 18. The other end of the L-shaped electrical terminal 18 is mechanically connected to an ignition cable 20 and electrically connected to the conductive core 22. The electrical connection between the conductive core 22 and the L-shaped electrical terminal 18 may be made by the conventional strip and fold method as taught by Barker et al in U.S. Pat. No. 3,284,751 or any other method known in the art.

A portion of the L-shaped electrical terminal 18 and a portion of the ignition cable 20, including the mechanical and electrical connection therebetween, are protected from the environment by an insulator boot 24 made from an elastomer or rubber-like material. The insulator boot 24 has an annular recess 26 in which is received a cylindrical extension 28 of the tower member 12 to form a watertight seal therebetween.

A portion of the insulator boot 24 is enclosed in a retainer 30 made from a structural plastic, which locks the insulator boot 24 and the L-shaped electrical terminal to the tower member 12. As shown in FIGS. 1 and 2, the retainer has a pair of pivotably mounted latch members 32 and 34. Each of the latch members 32 and 34 have a dog catch 36 which engages the underside of a radial flange 38 provided about the periphery of the tower member 12 to lock the retainer 30 to the tower member. The latch members 32 and 34 are formed integral with the retainer 30 and are resiliently biased by pivot bars 40 and 42 so that the dog catches 36 are biased towards each other and into engagement with the radial flange 38. The latch members 32 and 34 each have an arm 44 which extends upward from the pivot bars 40 and 42 in a direction opposite the dog catches 36. Gripper pads 46 provided at the ends of each of the arms 44 permit a service person to compress the arms 44 towards each other as indicated by arrows 48 and 50, pivoting the dog catches 36 away from each other and disengaging them from the radial flange 38. With the dog catches disengaged from the tower member's flange 38, the retainer 30 can be freely withdrawn from the tower member 12, disengaging the L-shaped electrical terminal 18 from the tower member's cup-shaped electrode 16.

To ensure that the insulator boot 24 will be withdrawn from the tower member 12 with the withdrawal of the retainer 30, a lock tab 52 is provided on the internal surface of the retainer 30 which engages a notch or recess 54 provided in the insulator boot 24. The engagement of the lock tab 52 in the notch 54 locks the insulator boot 24 in the retainer so that these two elements do not separate from each other during the disconnection of the retainer 30 and the L-shaped electrical terminal 18 from the tower member 12. Alternatively, the retainer 30 may be insert molded into the insulator boot 24 making a unified assembly eliminating both the lock tab 52 and the notch or recess 54.

It is recognized that the configuration of the various components of the electrical connector may be changed from those shown in the drawings without departing from the spirit of the invention as described herein and set forth in the appended claims. For example, a twist lock may be used in place of the latches to lock the retainer to the tower member or the lock tab which locks the insulator boot to the retainer may be provided on the insulator boot rather than the retainer and the notch for receiving the lock tab provided in the retainer. These types of modifications are fully within the scope of the invention as described herein.

What is claimed is:

1. A connector for connecting an electrical terminal of a spark plug cable to a high voltage output terminal of a distributorless ignition system, said connector comprising:

a dielectric tower member having an electrode for electrically connecting said electrical terminal of said spark plug cable with said high voltage output terminal of the distributorless ignition system;

an insulator boot having a central bore therethrough for receiving a portion of said electrical terminal and a portion of said spark plug cable therein, said insulator boot having a forward end engaging said tower member to form a watertight seal therebetween when said electrical terminal is electrically connected to said electrode; and retainer means for locking said insulator boot to said tower member in said watertight arrangement and for maintaining said electrical connection between said electrical terminal and said electrode.

2. The connector of claim 1, wherein said electrode has a cup-shaped portion for receiving one end of said electrical terminal and a threaded shaft extending from the bottom of said cup-shaped portion external to said tower member, said threaded shaft being connectable to said high voltage output terminal of the distributorles ignition system.

3. The connector of claim 2, wherein said electrical terminal and said insulator boot are L-shaped so that said spark plug cable and said insulator boot exit said retainer means in a direction normal to the direction of insertion of said electrical terminal into said cup-shaped portion of said electrode.

4. The connector of claim 1, wherein said tower member has a radial flange and said retainer means has a pair of latch members disposed on the opposite sides thereof, said latch members being engageable with said radial flange to lock said retainer means to said tower member.

5. The connector of claim 4, wherein a dog is provided at the end of each latch member to engage the surface of said radial flange which is opposite the surface adjacent to said retainer means.

6. The connector of claim 5, wherein said latch members are pivotally mounted to said retainer means and wherein each latch member has an extension arm which when pivotally displaced disengages said dogs from said radial flange permitting said retainer means to be withdrawn from said tower member to electrically disconnect said spark plug cable's electrical terminal from said tower member's electrode.

7. The connector of claim 6, wherein said insulator boot has a notch formed therein and said retainer means has a lock tab receivable in said notch to lock said insulator boot in said retainer means.

8. The connector of claim 2, wherein said tower member has a cylindrical extension circumscribing the open end of said cup-shaped portion of said electrode and wherein the end of said insulator boot facing said tower member has an annular recess for receiving said cylindrical extension to form said watertight seal therebetween.

9. The connector of claim 4, wherein said latch members are pivotally mounted to the sides of said retainer means and wherein said latch members further include means for pivoting said latch members to a position disengaged from said radial flange permitting said retainer means to be withdrawn from said tower member.

10. The connector of claim 9, wherein said latch members are formed integrally with said retainer means.

11. An electrical connector for connecting an L-shaped electrical terminal of a spark plug cable to a high voltage output terminal of a distributorless ignition system, said electrical connector comprising:

a dielectric tower member having a cup-shaped electrode for receiving the end of said L-shaped electrical terminal opposite the end connected to said spark plug cable, said cup-shaped electrode including means connectable to said high voltage output terminal of said distributorless ignition system;

an L-shaped insulator boot having a central bore therethrough for receiving therein a portion of said L-shaped electrical terminal and a contiguous portion of said spark plug cable, the forward end of said insulator boot engaging said tower member to form a watertight seal; and a retainer for locking said L-shaped boot to said tower member and holding said end of said L-shaped electrical terminal in said cup-shaped electrode.

12. The electrical connector of claim 11, wherein said connector has means for locking said L-shaped insulator boot in said retainer.

13. The electrical connector of claim 12, wherein said means for locking said L-shaped insulator boot in said retainer comprises a notch formed in one of said L-shaped insulator boot and said retainer and a lock tab provided on the other, wherein the engagement of said lock tab in said notch locks said L-shaped insulator boot to said retainer.

14. The electrical connector of claim 12, wherein said tower member has a radial flange and wherein said retainer has a pair of pivotably mounted latch members which are biased to engage with said radial flange to lock said retainer to said tower member.

15. The electrical connector of claim 14, wherein said latch members include means for disengaging said latch members from said radial flange.

16. The electrical connector of claim 11, wherein said means connectable to said high voltage output terminal comprises a threaded shaft extending from the bottom of said cup-shaped electrode external to said tower member.

17. A spark plug ignition cable for electrically connecting the high voltage output terminal of a distributorless ignition system to a spark plug comprising:

a length of ignition cable wire having a first electrical terminal provided at one end and a second electrical terminal connectable to a spark plug provided at the other end;

an insulator boot circumscribing a portion of said first electrical terminal and a contiguous portion of said ignition cable wire;

a dielectric tower member having an electrode for connecting said first electrical terminal to said high voltage output terminal of said distributorless ignition system, said tower member engaging the adjacent portion of said insulator boot to form a watertight seal when said first electrical terminal is electrically connected to said electrode; and a retainer for locking said insulator boot to said tower member and holding said first electrical terminal in electrical connection with said electrode.

18. The spark plug ignition cable of claim 17, wherein said electrode comprises a cup-shaped portion for receiving the end of said first electrical terminal opposite the end connected to said length of ignition cable wire and means for connecting said cup-shaped portion to said high voltage output terminal of said distributorless ignition system.

19. The spark plug ignition cable of claim 18, wherein said means for connecting said cup-shaped portion to said high voltage output terminal is a threaded shaft protruding from the bottom of said cup-shaped portion.

20. The spark plug ignition cable of claim 17, wherein said tower member has a radial flange and wherein said retainer has at least two latch members engageable with said radial flange to lock said retainer to said tower member, the locking of said retainer to said tower member holding said insulator boot against said tower member to form said watertight seal and holding said first electrical terminal in said cup-shaped portion of said electrode.

21. The spark plug ignition cable of claim 20, wherein said at least two latch members comprise two latch members pivotably mounted to opposite sides of said retainer, said two latch members having means for disengaging said latch members from said radial flange permitting said retainer to be disconnected from said tower member.

22. The spark plug ignition cable of claim 21, wherein said tower member has a cylindrical extension surrounding the open end of said cup-shaped portion of said electrode, and wherein said insulator boot has a recess provided in its end facing said tower member for receiving said cylindrical extension to make said watertight seal.

23. The spark plug ignition cable of claim 22, wherein said insulator boot has a notch provided therein and said retainer has a lock tab receivable in said notch to lock said insulator boot in said retainer.

24. The spark plug ignition cable of claim 23, wherein said first electrical terminal and said insulator boot are L-shaped permitting said insulator boot and said length of ignition cable wire to exit said retainer in a direction normal to the direction of insertion of said end of said first electrical terminal into said cup-shaped portion of said electrode.

25. A spark plug ignition cable for electric-ally connecting the high voltage output terminal of a distributorless ignition system to a spark plug in which the distributorless ignition system includes a tower member having an electrode connected to the high voltage output terminal and a radial flange, said spark plug cable comprising:

a length of ignition cable wire having a first electrical terminal provided at one end and a second electrical terminal connectable to a spark plug provided at the other end;

an insulator boot circumscribing a portion of said first ignition terminal and a contiguous portion of said ignition cable wire, said insulator boot engaging said tower member to form a watertight seal therebetween; and a retainer having at least one latch member engageable with said radial flange to lock said insulator boot to said tower member to form said watertight seal and to hold said first electrical terminal in electrical contact with said electrode of said tower member.

26. The spark plug ignition cable of claim 25 wherein said tower member has a cylindrical extension circumscribing said electrode, said insulator boot has an annular recess provided in its end which faces said dielectric tower member, said annular recess receiving said cylindrical extension to make said watertight seal.

27. The spark plug ignition cable of claim 26 wherein said first electrical terminal and said insulator boot are L-shaped and exit said retainer normal to the direction of insertion of said spark plug ignition cable onto said tower member.

* * * * *

UNITED STATES PATENT AND TRADEMARK OFFICE

CERTIFICATE OF CORRECTION

PATENT NO. : 4,790,767

DATED : December 13, 1988

INVENTOR(S) : Sturdevan et al

It is certified that error appears in the above-identified patent and that said Letters Patent is hereby corrected as shown below:

Column 3, line 13, delete "i" and insert ---- is ----.

Column 4, line 41, delete "distributorles" and insert ---- distributorless ----.

Column 6, line 60, delete "electric-ally" and insert ---- electrically ----.

Column 6, line 63, after "a" insert ---- dielectric ----.

Signed and Sealed this

Fourth Day of July, 1989

*Attest:*

*Attesting Officer*

DONALD J. QUIGG

*Commissioner of Patents and Trademarks*